US009260925B2

(12) United States Patent
Schulte et al.

(10) Patent No.: US 9,260,925 B2
(45) Date of Patent: Feb. 16, 2016

(54) THREADED CONNECTIONS AND METHODS

(71) Applicant: Houston International Specialty, Inc., Spring, TX (US)

(72) Inventors: Warren Harold Schulte, Porter, TX (US); Aubrey Coy Reece, Montgomery, TX (US)

(73) Assignee: Houston International Specialty, Inc., Spring, TX (US)

( * ) Notice: Subject to any disclaimer, the term of this patent is extended or adjusted under 35 U.S.C. 154(b) by 279 days.

(21) Appl. No.: 13/946,702

(22) Filed: Jul. 19, 2013

(65) Prior Publication Data

US 2015/0021046 A1 Jan. 22, 2015

(51) Int. Cl.
*E21B 17/042* (2006.01)

(52) U.S. Cl.
CPC ..... *E21B 17/042* (2013.01)

(58) Field of Classification Search
CPC ..... E21B 17/02; E21B 17/042; F16L 15/002; F16L 25/0018
See application file for complete search history.

(56) References Cited

U.S. PATENT DOCUMENTS

| | | | | |
|---|---|---|---|---|
| 3,854,760 | A * | 12/1974 | Duret | 285/334 |
| 4,673,201 | A * | 6/1987 | Dearden et al. | 285/333 |
| 4,706,997 | A * | 11/1987 | Carstensen | 285/13 |
| 5,794,985 | A | 8/1998 | Mallis | |
| 6,817,633 | B2 | 11/2004 | Brill | |
| 7,347,459 | B2 | 3/2008 | Geary | |
| 7,438,329 | B2 | 10/2008 | DeLange | |
| 8,525,255 | B2 | 8/2009 | Reynolds, Jr. | |
| 2006/0125234 | A1 * | 6/2006 | Ernst et al. | 285/333 |
| 2006/0152000 | A1 * | 7/2006 | DeLange et al. | 285/334 |
| 2008/0179884 | A1 | 7/2008 | Geary | |
| 2012/0074692 | A1 * | 3/2012 | Chelette et al. | 285/333 |

* cited by examiner

*Primary Examiner* — William P Neuder

(57) ABSTRACT

Threaded couplings and methods for use in drilling with casing can include first and second male members having exterior threads engaged with interior threads of a female member. Exterior shoulders of the male members can abut interior shoulders of the female member to facilitate placement of the male members such that pin noses thereof are positioned at the center of the female member, where abutment between the pin noses of the male members can form a seal. The shoulders can be provided with negative angles to prevent disengagement. Tapered surfaces can be provided on the male members, to contact tapered surfaces on the female member to form metal-to-metal seals for enhancing the integrity of the connection, a straight thread configuration can be used to maximize the thickness of the coupling, and bearing journals or guides can be used to facilitate engagement of the threads and retention of the engagement.

27 Claims, 2 Drawing Sheets

THREADED CONNECTIONS AND METHODS

FIELD

Embodiments usable within the scope of the present disclosure relate, generally, to threaded couplings and methods, and more specifically to connections and methods usable during drilling-with-casing and/or other oilfield operations.

BACKGROUND

During drilling-with-casing operations, and/or other operations during which a string of connected tubular segments must be extended and/or retrieved, it is necessary to provide a torque to complementary threaded members sufficient to form a fluid-tight seal therebetween. Conduits that must withstand significant fluid pressures, such as drill pipe and other oilfield tubulars, require a significant torque (up to 50,000 foot-pounds, or more) to form such a seal, while conduits used during drilling-with-casing operations may require an even more robust seal and/or multiple seals. For example, "premium" threaded couplings, such as that disclosed in the United States application for patent having the application Ser. No. 12/925,430, filed Oct. 21, 2010, which is incorporated by reference in its entirety herein, can include multiple seals between connected components. In the industry, premium couplings are often formed using costly materials, such as tubular components having a wall thickness greater than that of standard components.

A need exists for threaded couplings and methods that are usable during drilling-with-casing and other oilfield operations that can be produced using less costly components than those used with existing premium connections, and in various embodiments, using standard (e.g., API) stock materials.

A need also exists for threaded couplings and methods that are usable during drilling-with-casing and other oilfield operations that include features for enabling accurate positioning of components while ensuring integrity of the connection.

Embodiments usable within the scope of the present disclosure meet these needs.

SUMMARY

Embodiments usable within the scope of the present disclosure relate to threaded couplings and methods, usable during drilling-with-casing operations and/or other oilfield operations. A first male member (e.g., a pin member) having exterior threads, a first pin nose, and a first exterior shoulder associated with the first pin nose, and a second male member (e.g., a pin member) having exterior threads, a second pin nose, and a second exterior shoulder associated with the second pin nose, can be engaged with a female member (e.g., a box member) having a center, first interior threads engaged with the first exterior threads, and second interior threads engaged with the second exterior threads. A first internal shoulder of the female member can abut the first exterior shoulder of the first male member, and a second internal shoulder of the female member can about the second exterior shoulder of the second male member. Abutment between the internal and external shoulders can thereby position the first pin nose and the second pin nose at the center of the female member. In an embodiment, contact between the first and second pin noses can form a seal therebetween (e.g., when the connection between the male members and the female member is torqued). Such a seal can include a metal-to-metal seal, or in an embodiment, any manner of compressible member (e.g., an o-ring or gasket) could be present at or proximate to the center of the female member and/or one or both pin noses of the male members. In an embodiment, one or more of the internal and/or external shoulders can include a negative angle (e.g., −10 to −20 degrees, and in an embodiment approximately −15 degrees) to facilitate precise positioning of the pin noses and for preventing disengagement between the male and female members (e.g., due to bending moments applied to the coupling).

In a further embodiment, one or a plurality of the threads of the male and/or female members can include a straight thread configuration. Formation of a straight thread configuration on a threaded component typically requires the removal of less material from the component than the formation of other threaded configurations (e.g., tapered threads), such that a threaded coupling that includes a straight thread configuration has a larger maximum width (e.g., thickness) than a similar coupling with an alternate thread configuration. To facilitate the retention of the engagement between complementary threads, the thread form can include negative load flanks and/or a hook thread configuration.

In an embodiment, a bearing journal and/or guide, associated with the exterior threads of either or both male members, can be used to facilitate alignment and engagement between the sets of threads. For example, cylindrical bearing journals can be positioned between the male and female components at the mouth of the coupling e.g., to prevent bending and deflection of the connection when passing through curves, which can prevent "walking" and/or other undesired movement of the engaged threads relative to one another.

In a further embodiment, at least one of the male members can include a tapered external surface (e.g., having a taper angle ranging from 1 degree to 2 degrees, and in an embodiment, approximately 1.75 degrees), which abuts a tapered internal surface of the female member (e.g., having a similar or different taper angle as that of the corresponding male member) to form a metal-to-metal seal between the female member and the one or more male members, thereby enhancing the fluid-tight nature of the coupling in a manner that can be accomplished when the connection is torqued.

BRIEF DESCRIPTION OF THE DRAWINGS

In the detailed description of various embodiments of the present invention presented below, reference is made to the accompanying drawings, in which.

Embodiments of the present disclosure are described below with reference to the listed Figures.

DETAILED DESCRIPTION OF THE EMBODIMENTS

Before describing selected embodiments of the present invention in detail, it is to be understood that the present invention is not limited to the particular embodiments described herein. The disclosure and description of the invention is illustrative and explanatory of one or more presently preferred embodiments of the invention and variations thereof, and it will be appreciated by those skilled in the art that various changes in the design, organization, order of operation, means of operation, equipment structures and location, methodology, and use of mechanical equivalents, as well as in the details of the illustrated construction or combinations of features of the various elements, may be made without departing from the spirit of the invention.

As well, the drawings are intended to describe the concepts of the invention so that the presently preferred embodiments of the invention will be plainly disclosed to one of skill in the art, but are not intended to be manufacturing level drawings or renditions of final products and may include simplified conceptual views as desired for easier and quicker understanding or explanation of the invention. As well, the relative size and arrangement of the components may differ from that shown and still operate within the spirit of the invention as described throughout the present application.

Moreover, it will be understood that various directions such as "upper", "lower", "bottom", "top", "left", "right", and so forth are made only with respect to explanation in conjunction with the drawings, and that the components may be oriented differently, for instance, during transportation and manufacturing as well as operation. Because many varying and different embodiments may be made within the scope of the inventive concept(s) herein taught, and because many modifications may be made in the embodiments described herein, it is to be understood that the details herein are to be interpreted as illustrative and non-limiting.

Figure 1:
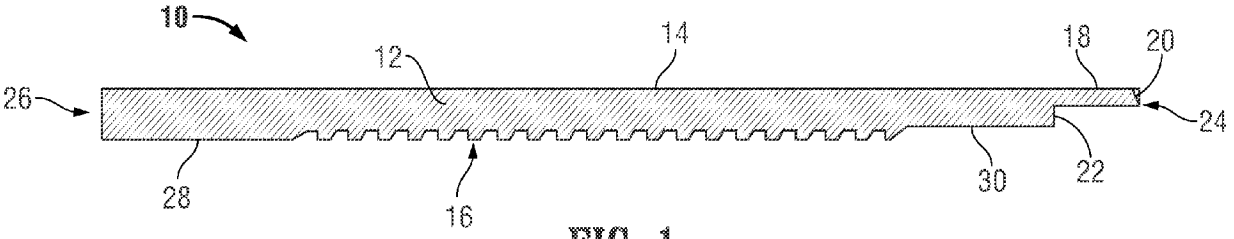
FIG. 1 depicts a cross-sectional view of an embodiment of a first male component of a threaded coupling usable within the scope of the present disclosure.

Referring now to FIG. 1, a side cross-sectional view of an embodiment of a first male component (10), e.g., a pin member, is shown, having a generally tubular (e.g., cylindrical) body (12) with a generally flat and/or smooth interior surface (14) thereby defining a throughbore for communication of fluid when connected with adjacent components. A first set of threads (16), shown having a generally straight thread configuration with a tapered stab flank and a negative-angled load flank (e.g., a hook thread configuration), is formed along the exterior surface of the body (12). Use of a straight thread configuration (e.g., rather than a tapered thread configuration) enables the threads (16) to be formed in the male component (10) by removing a minimum amount of material from the body (12), thereby maximizing the thickness thereof, which can provide increased strength and integrity to a threaded connection formed using the male component (10).

A first pin nose (18), having a face (20), is positioned at a first (e.g., inner) end (24) of the first male component (10). A first external shoulder (22) is shown adjacent to the first pin nose (18) and is usable to position the first pin nose (18) at a desired position within a corresponding (e.g., female) component through abutment between the first external shoulder (22) and a complementary shoulder. While FIG. 1 depicts a single external shoulder (22) generally adjacent to the first pin nose (18), it should be understood that any number of shoulders could be positioned at any point along the length of the first male component (10), such that abutment between the one or more shoulders and complementary shoulders (e.g., along a corresponding female member) can accurately position the pin nose (18). In the depicted embodiment, the first external shoulder (22) is shown having a negative angle relative to the longitudinal axis of the male component (10).

Proximate to the external shoulder (22), a first tapered external surface (30) (e.g., a sealing surface) is shown, which, upon contact with a corresponding surface (e.g., in a female component) and torquing of the connection, can form a metal-to-metal seal to enhance the integrity of the coupling. While FIG. 1 depicts a single tapered external surface (30) proximate to the first end (24) of the male component (10), it should be understood that one or more tapered surfaces could be positioned anywhere along the length of the male component (10) without departing from the scope of the present disclosure.

A bearing journal (28) (e.g., a cylindrical journal and/or similar type of guide) is shown at the second (e.g., outer) end (26) of the first male component (10), such that when the male component (10) is engaged with a corresponding (e.g., female) member, the bearing journal (28) is positioned at the mouth of the coupling and can prevent bending and/or deflection of the connection, such as when passing through curves.

While the dimensions and/or material composition of the first male component (10) can vary depending on the nature of the connection, in an exemplary embodiment, the male component (10) can have an outer diameter of 5.480 inches, a wall thickness of 0.304 inches at its thickest point, and an overall length ranging from 5 to 6 inches. The threads (16) can include a major diameter of 5.460 inches, a minor diameter of 5.368 inches, a thread depth of 0.46 inches, and 6 turns per inch. The taper and/or seal angle of the tapered surface (30) can be 1.7756 degrees, while the shoulder (22) can extend at a negative angle of 15 degrees.

Figure 2:
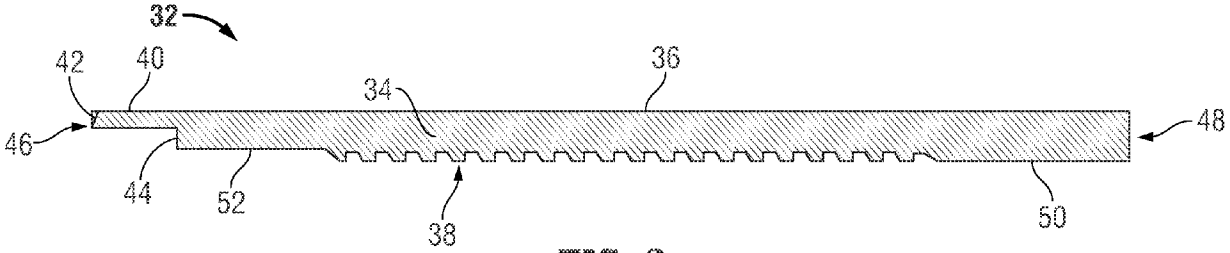
FIG. 2 depicts a cross-sectional view of an embodiment of a second male component of a threaded coupling usable within the scope of the present disclosure.

Referring now to FIG. 2, a side, cross-sectional view of an embodiment of a second male component (32) e.g., a pin member, is shown, having a configuration generally similar or identical to that of the first male component (10), depicted in FIG. 1. While FIG. 2 depicts a second male component (32) similar or identical to the first male component, it should be understood that embodiments usable within the scope of the present disclosure could include male components having differing dimensions, material compositions, and/or configurations without departing from the scope of the present disclosure.

The second male component (32) is shown having a generally cylindrical body (34) with an interior surface (36) opposite exterior threads (38) having a straight thread configuration. A pin nose (40) with a face (42) is shown at a first end (46) of the component (32), adjacent to an associated external shoulder (44) usable to position the pin nose (40) through contact with a complementary shoulder, and in an embodiment, the shoulder (44) can include a negative angle to resist disengagement of the second male component (32) from a complementary (e.g., female) component. A bearing journal or guide (50) is shown at the second end (48) of the component (32), while a tapered external surface (52) is shown adjacent to the shoulder (44), and is usable to form a metal-to-metal seal through contact with a complementary tapered surface.

As described above with reference to FIG. 1, while FIG. 2 depicts an exemplary arrangement of components, it should be understood that, for example, the second external shoulder (44) and/or the second tapered external surface (52) could be positioned at any location along the length of the second male component (32), and that while a single shoulder and tapered surface are depicted, any number of such components could be present without departing from the scope of the present disclosure.

Figure 3:
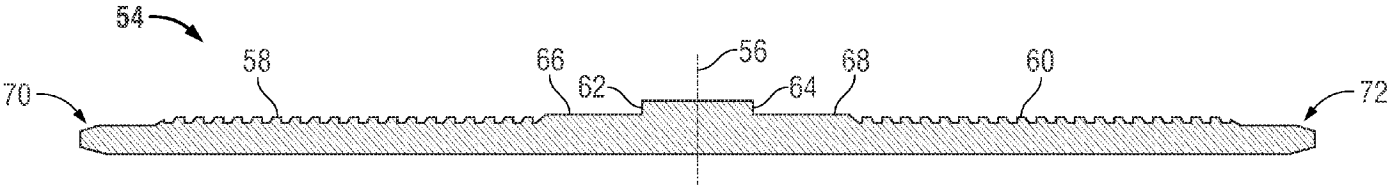
FIG. 3 depicts a cross-sectional view of an embodiment a female component of a threaded coupling usable within the scope of the present disclosure.

Referring now to FIG. 3, a female component (54) (e.g., a box member), adapted for engagement with complementary male components (e.g., pin members such as the male components depicted in FIG. 1 and FIG. 2). The female component (54) includes a center (56) (e.g., positioned at the approximate midpoint along the length thereof), having a first set of interior threads (58) on one side thereof, and a second set of interior threads (60) on the other side thereof. A first interior shoulder (62) is shown associated with the first interior threads (58) (e.g., adjacent thereto), and a second interior shoulder (64) is similarly shown associated with the second interior threads (60). A first tapered interior surface (66) is shown adjacent to the first interior shoulder (62), and a second tapered interior surface (68) is shown adjacent to the second interior shoulder (64). It should be understood, however, that while FIG. 3 depicts shoulders (62, 64) adjacent to tapered surfaces (66, 68), which are in turn adjacent to and located interior relative to two sets of threads (58, 60), the depicted arrangement and configuration of components is an exemplary embodiment, and any number of shoulders and tapered surfaces can be positioned at any location within the female component (54) without departing from the scope of the present disclosure. In use, the threads (58, 60) can be engaged with complementary threads (e.g., those of male components), while the interior shoulders (62, 64) can abut exterior shoulders of complementary components. A bearing journal or guide, such as those shown in FIG. 1 and FIG. 2, can facilitate engagement between corresponding threads and prevent disengagement, the bearing journals or guides being positioned at or proximate to first and second ends (70, 72) of the female component (54) after engagement. As described above, abutment between complementary shoulders can be used to facilitate proper positioning of the pin noses of the male components (e.g., at or proximate to the center (56) of the female component (54)). Tapered external surfaces of male components can contact the tapered interior surfaces (66, 68) to form metal-to-metal seals, further enhancing the connection.

While the dimensions and/or material composition of the female component (54) can vary depending on the nature of the connection, in an exemplary embodiment, the female component (54) can have an overall length of 10.625 inches, and an outer diameter of about 6 inches. The taper and/or seal angle of the tapered surfaces (66, 68) can be 1.7756 degrees, while the shoulders (62, 64) can extend at an angle of about 15 degrees.

Figure 4:
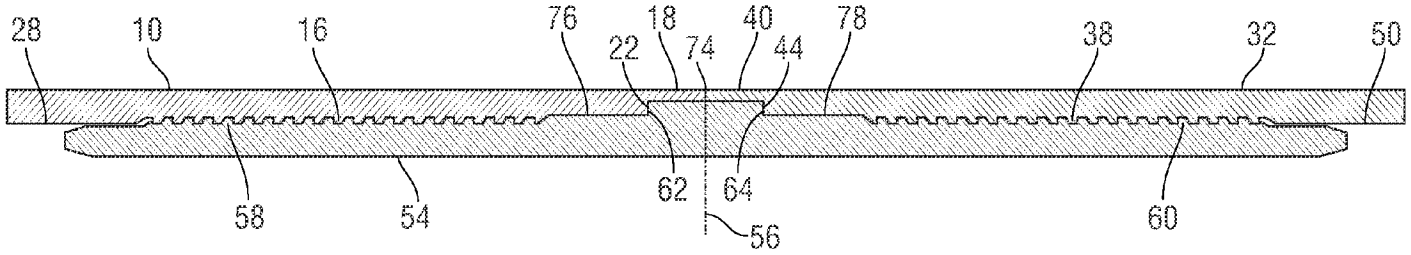
FIG. 4 depicts a cross-sectional view of an embodiment of a threaded coupling formed through engagement between the male and female components shown in FIG. 1, FIG. 2, and FIG. 3.

Referring now to FIG. 4, a side, cross-sectional view of an embodiment of a threaded coupling, formed through engagement between the first male component (10) shown in FIG. 1, the second male component (32) shown in FIG. 2, and the female component (54) shown in FIG. 3, is depicted. The first set of exterior threads (16) is shown engaged with the first set of interior threads (58), the engagement and retention of which can be facilitated by the first bearing journal or guide (28). When the first male component (10) is engaged with the female component (54) in the manner depicted, the first external shoulder (22) abuts the first internal shoulder (62), which can form a sealed and/or torqued engagement, in addition to facilitating the proper positioning of the first pin nose (18). Specifically, the end of the first pin nose (18) is positioned at the center (56) of the coupling, due to contact between the first external and internal shoulders (22, 62) preventing extension of the first pin nose (18) beyond the center (56). Contact between the first tapered external surface and the first tapered internal surface forms a first metal-to-metal seal (76), enhancing the integrity and fluid-tight nature of the connection.

Similarly, the second set of exterior threads (38) is shown engaged with the second set of interior threads (60), the engagement and retention of which can be facilitated by the second bearing journal or guide (50). Abutment between the second external shoulder (44) and the second internal shoulder (64) can form a sealed and/or torque engagement, and can facilitate proper positioning of the second pin nose (40). Specifically, the end of the second pin nose (40) is positioned at the center (56) of the coupling, due to contact between the second external and internal shoulders (44, 64). When the connection is torqued, the end of the first pin nose (18) and the end of the second pin nose (40) can be urged into contact with one another, forming a torqued and/or sealed engagement (74), thereby providing the coupling with a generally smooth and/or continuous interior surface that is fluid-tight at the point of connection. Contact between the second tapered external surface and the first tapered internal surface forms a second metal-to-metal seal (78), enhancing the integrity and fluid-tight nature of the connection.

Figure 5:
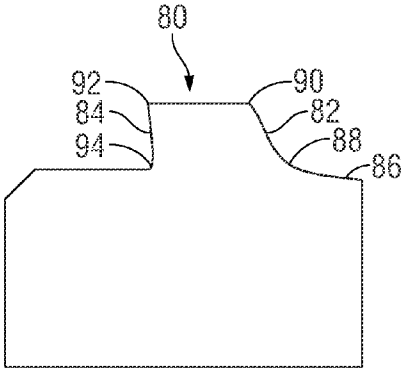
FIG. 5 depicts a diagrammatic view of an embodiment of a thread profile usable within the connection of FIG. 4.

FIG. 5 depicts a diagrammatic side view of an exemplary thread profile usable within the scope of the present disclosure. A single thread (80) is shown, having a stab flank (82), having an angle of approximately thirty degrees relative to the thread axis, opposite a load flank (84) having a negative angle of approximately nine degrees, which can resist disengagement from complementary threads. The stab flank (82) meets a generally flat exterior surface of the thread (80) at a point of engagement (90) having a radius of curvature of approximately 0.011 inches, while the load flank (84) meets the exterior surface of the thread (80) at a point of engagement (92) having a radius of curvature of approximately 0.008 inches. A tapered front face (86) of the thread profile is shown having an approximately ten degree taper relative to the longitudinal axis of the component from which the thread (80) extends, meeting the stab flank (82) at a point of engagement (88) having a radius of curvature of approximately 0.015 inches. The load flank (84) intersects the body of the component from which the thread (80) extends at a point of engagement (94) having a radius of curvature of approximately 0.008 inches. It should be understood, however, that the specific thread profile illustrated in FIG. 5 is exemplary, and other thread configurations can be used without departing from the scope of the present disclosure.

The embodied coupling can thereby incorporate pin nose to pin nose makeup, providing greater torque capacity, while providing the coupling with a generally smooth and/or continuous, fluid-tight interior surface, while using torque shoulders to enable precise positioning of the pin noses, which in an embodiment, can include negative angles to prevent disengagement. Incorporation of metal-to-metal seals between male and female components can further enhance the integrity and fluid-tight nature of the connection, while the use of straight thread forms can minimize the amount of material that must be removed from the tubular stock to form the components, thereby maximizing the thickness and strength of the coupling. Additionally, embodiments can include use of thread forms having negative load flanks, minimizing the possibility of unintentional disengagement of threads. Bearing journals or guides between the male and female components can facilitate engagement of the threads and prevent disengagement through prevention of bending and deflection of the coupling, e.g., through curves. The configurations described above can prevent concentration of high stresses in any point of the coupling, which could otherwise lead to shear failure. Additionally, the ability to engage the male and female components, without over-torquing the coupling, can be gauged both at the face of the coupling, and at the shoulders (e.g., of the male components).

While various embodiments of the present invention have been described with emphasis, it should be understood that within the scope of the appended claims, the present invention might be practiced other than as specifically described herein.

What is claimed is:

1. A threaded coupling for use in drilling with casing, the threaded coupling comprising:

a first male member comprising first exterior threads, a first pin nose, and a first exterior shoulder associated with the first pin nose;

a second male member comprising second exterior threads, a second pin nose, and a second exterior shoulder associated with the pin nose; and a female member comprising a center, first interior threads engaged with the first exterior threads, second interior threads engaged with the second exterior threads, a first internal shoulder abutting the first exterior shoulder, and a second internal shoulder abutting the second exterior shoulder, wherein abutment between the first internal shoulder and the first exterior shoulder positions the first pin nose at the center of the female member, wherein abutment between the second internal shoulder and the second exterior shoulder positions the second pin nose at the center of the female member, and wherein the first exterior shoulder, the first internal shoulder, the second exterior shoulder, the second internal shoulder, or combinations thereof, comprises a negative angle relative to a longitudinal axis of the coupling for preventing disengagement of the first male member, the second male member, or combinations thereof.

2. The threaded coupling of claim 1, wherein the first exterior threads, the second exterior threads, the first interior threads, the second interior threads, or combinations thereof comprise a straight thread configuration for maximizing a width of the first male member, the second male member, the female member, or combinations thereof.

3. The threaded coupling of claim 1, wherein the first pin nose contacts the second pin nose forming a seal therebetween.

4. The threaded coupling of claim 1, further comprising a bearing journal or guide associated with the first exterior threads, the second exterior threads, or combinations thereof for facilitating alignment and engagement between the first exterior threads and the first interior threads, the second exterior threads and the second interior threads, or combinations thereof.

5. The threaded coupling of claim 1, wherein at least one of the first male member and the second male member comprises a tapered external surface, and wherein the female member comprises at least one tapered internal surface that abuts the tapered external surface and forms a metal-to-metal seal between the female member and said at least one of the first male member and the second male member.

6. A threaded coupling for use in drilling with casing, the threaded coupling comprising:

a first male member comprising first exterior threads having a straight thread configuration, a first pin nose, a first tapered external surface, and a first exterior shoulder associated with the first pin nose, wherein the first exterior shoulder extends at a negative angle relative to a longitudinal axis of the coupling;

a second male member comprising second exterior threads having a straight thread configuration, a second pin nose, a second tapered external surface, and a second exterior shoulder associated with the second pin nose, wherein the second exterior shoulder extends at a negative angle relative to the longitudinal axis of the threaded coupling; and a female member comprising a center, first interior threads having a straight thread configuration and engaged with the first exterior threads, second interior threads having a straight thread configuration and engaged with the second exterior threads, a first internal shoulder abutting the first exterior shoulder, a second internal shoulder abutting the second exterior shoulder, a first tapered internal surface abutting the first tapered external surface to form a metal-to-metal seal between the first male member and the female member, and a second tapered internal surface abutting the second tapered external surface to form a metal-to-metal seal between the second male member and the female member, wherein the first internal shoulder and the second internal shoulder extend at a negative angle relative to the longitudinal axis of the threaded coupling for preventing disengagement of the first male member, the second male member, or combinations thereof, wherein abutment between the first internal shoulder and the first exterior shoulder positions the first pin nose at the center of the female member, and wherein abutment between the second internal shoulder and the second exterior shoulder positions the second pin nose at the center of the female member such that the first pin nose contacts the second pin nose to form a seal therebetween.

7. The threaded coupling of claim 6, further comprising a bearing journal or guide associated with the first exterior threads, the second exterior threads, or combinations thereof for facilitating alignment and engagement between the first exterior threads and the first interior threads, the second exterior threads and the second interior threads, or combinations thereof.

8. The threaded coupling of claim 6, wherein the negative angle ranges from negative ten degrees to negative twenty degrees.

9. The threaded coupling of claim 8, wherein the negative angle is approximately negative fifteen degrees.

10. The threaded coupling of claim 6, wherein the first tapered external surface, the first tapered internal surface, the second tapered external surface, the second tapered internal surface, or combinations thereof, comprises a taper angle ranging from one degree to two degrees.

11. The threaded coupling of claim 10, wherein the taper angle is approximately 1.75 degrees.

12. The threaded coupling of claim 6, wherein the straight thread configuration comprises a hook thread configuration.

13. The threaded coupling of claim 6, wherein contact between the first pin nose and the second pin nose forms a first seal, wherein contact between the first external shoulder and the first internal shoulder forms a second seal, wherein contact between the second external shoulder and the second internal shoulder forms a third seal, wherein contact between the first tapered internal surface and the first tapered external surface forms a fourth seal, and wherein contact between the second tapered internal surface and the second tapered external surface forms a fifth steal.

14. A method for connecting a coupling for use in drilling with casing, the method comprising the steps of:

threading a first male member with a female member to contact a first exterior shoulder of the first male member with a first interior shoulder of the female member, wherein abutment between the first internal shoulder and the first exterior shoulder positions a first pin nose of the first male member at a center of the female member;

threading a second male member with the female member to contact a second exterior shoulder of the second male member with a second interior shoulder of the female member, wherein abutment between the second internal shoulder and the second exterior shoulder positions a second pin nose of the second male member at the center of the female member; and applying a force to the coupling, wherein a negative angle of the first exterior shoulder, the first internal shoulder, the second exterior shoulder, the second internal shoulder, or combinations thereof, prevents disengagement of the first male member, the second male member, or combinations thereof.

15. The method of claim 14, wherein threading the first male member with the female member, threading the second male member with the female member, or combinations thereof, comprises engaging threads having a straight thread configuration with complementary threads having a straight thread configuration for maximizing a width of the first male member, the second male member, the female member, or combinations thereof.

16. The method of claim 15, wherein engaging the threads with the complementary threads comprises using a bearing journal or guide to align the threads with the complementary threads and prevent disengagement of the threads from the complementary threads.

17. The method of claim 14, wherein threading the first male member with the first female member and threading the second male member with the second female member comprises contacting the first pin nose with the second pin nose to form a seal therebetween.

18. The method of claim 14, wherein threading the first male member with the female member, threading the second male member with the female member, or combinations thereof, comprises abutting a tapered internal surface of the female member with a tapered external surface of at least one of the first male member and the second male member to form a metal-to-metal seal between the female member and said at least one of the first male member and the second male member.

19. A method for connecting a coupling for use in drilling with casing, the method comprising the steps of:

threading a first male member with a female member to contact a first exterior shoulder of the first male member with a first interior shoulder of the female member, wherein abutment between the first internal shoulder and the first exterior shoulder positions a first pin nose of the first male member at a center of the female member; and threading a second male member with the female member to contact a second exterior shoulder of the second male member with a second interior shoulder of the female member, wherein abutment between the second internal shoulder and the second exterior shoulder positions a second pin nose of the second male member at the center of the female member, wherein threading the first male member with the female member, threading the second male member with the female member, or combinations thereof, comprises engaging threads having a straight thread configuration with complementary threads having a straight thread configuration for maximizing a width of the first male member, the second male member, the female member, or combinations thereof, and wherein engaging the threads with the complementary threads comprises using a bearing journal or guide to align the threads with the complementary threads and prevent disengagement of the threads from the complementary threads.

20. The method of claim 19, wherein threading the first male member with the first female member and threading the second male member with the second female member comprises contacting the first pin nose with the second pin nose to form a seal therebetween.

21. The method of claim 19, further comprising applying a force to the threaded coupling, wherein a negative angle of the first exterior shoulder, the first internal shoulder, the second exterior shoulder, the second internal shoulder, or combinations thereof, prevents disengagement of the first male member, the second male member, or combinations thereof.

22. The method of claim 19, wherein threading the first male member with the female member, threading the second male member with the female member, or combinations thereof, comprises abutting a tapered internal surface of the female member with a tapered external surface of at least one of the first male member and the second male member to form a metal-to-metal seal between the female member and said at least one of the first male member and the second male member.

23. A threaded coupling for use in drilling with casing, the threaded coupling comprising:

a first male member comprising first exterior threads, a first pin nose, and a first exterior shoulder associated with the first pin nose;

a second male member comprising second exterior threads, a second pin nose, and a second exterior shoulder associated with the pin nose;

a female member comprising a center, first interior threads engaged with the first exterior threads, second interior threads engaged with the second exterior threads, a first internal shoulder abutting the first exterior shoulder, and a second internal shoulder abutting the second exterior shoulder, wherein abutment between the first internal shoulder and the first exterior shoulder positions the first pin nose at the center of the female member, and wherein abutment between the second internal shoulder and the second exterior shoulder positions the second pin nose at the center of the female member; and a bearing journal or guide associated with the first exterior threads, the second exterior threads, or combinations thereof for facilitating alignment and engagement between the first exterior threads and the first interior threads, the second exterior threads and the second interior threads, or combinations thereof.

24. The threaded coupling of claim 23, wherein the first exterior threads, the second exterior threads, the first interior threads, the second interior threads, or combinations thereof comprise a straight thread configuration for maximizing a width of the first male member, the second male member, the female member, or combinations thereof.

25. The threaded coupling of claim 23, wherein the first pin nose contacts the second pin nose forming a seal therebetween.

26. The threaded coupling of claim 23, wherein the first exterior shoulder, the first internal shoulder, the second exterior shoulder, the second internal shoulder, or combinations thereof, comprises a negative angle relative to a longitudinal axis of the coupling for preventing disengagement of the first male member, the second male member, or combinations thereof.

27. The threaded coupling of claim 23, wherein at least one of the first male member and the second male member comprises a tapered external surface, and wherein the female member comprises at least one tapered internal surface that abuts the tapered external surface and forms a metal-to-metal seal between the female member and said at least one of the first male member and the second male member.

* * * * *